US007168406B2

(12) United States Patent
Kiker

(10) Patent No.: US 7,168,406 B2
(45) Date of Patent: Jan. 30, 2007

(54) IGNITION SPARK ENHANCING SYSTEM AND DEVICES THEREFOR

(76) Inventor: Harvey George Kiker, 3601 E. Ramsey Way, Avon Park, FL (US) 33825

( * ) Notice: Subject to any disclaimer, the term of this patent is extended or adjusted under 35 U.S.C. 154(b) by 0 days.

(21) Appl. No.: 11/373,762

(22) Filed: Mar. 10, 2006

(65) Prior Publication Data

US 2006/0150961 A1 Jul. 13, 2006

Related U.S. Application Data

(63) Continuation-in-part of application No. 10/832,021, filed on Apr. 26, 2004, now Pat. No. 7,051,723.

(51) Int. Cl.
*H01T 13/05* (2006.01)
*F02P 15/12* (2006.01)

(52) U.S. Cl. ..... 123/143 C; 123/620; 123/169 PA; 439/125

(58) Field of Classification Search ..... 123/169 PH, 123/620, 169 PA, 143 C, 536, 647, 633; 439/125, 126, 127, 502
See application file for complete search history.

(56) References Cited

U.S. PATENT DOCUMENTS

| | | | | |
|---|---|---|---|---|
| 3,939,814 | A | | 2/1976 | Bergstresser |
| 4,193,651 | A | | 3/1980 | Hays |
| 4,269,160 | A | | 5/1981 | Irvin |
| 4,494,520 | A | | 1/1985 | Huritz |
| 4,502,025 | A | | 2/1985 | Carl |
| 4,596,222 | A | | 6/1986 | Ortiz |
| 4,665,922 | A | | 5/1987 | Gillbrand et al. |
| 4,774,914 | A | | 10/1988 | Ward |
| 4,784,100 | A | | 11/1988 | Huan |
| 4,944,280 | A | | 7/1990 | Washington |
| 5,109,828 | A | | 5/1992 | Tagami et al. |
| 5,134,985 | A | | 8/1992 | Rao |
| 5,576,514 | A | * | 11/1996 | Fujimoto et al. ..... 174/110 R |
| 6,089,214 | A | | 7/2000 | Anderson |
| 6,328,010 | B1 | | 12/2001 | Thurman |
| 6,358,072 | B1 | | 3/2002 | Johnson |
| 6,374,816 | B1 | | 4/2002 | Funk et al. |
| 6,736,119 | B1 | | 5/2004 | Kiker |
| 6,797,298 | B2 | | 9/2004 | Kiker |

* cited by examiner

*Primary Examiner*—Stephen K. Cronin
*Assistant Examiner*—Arnold Castro
(74) *Attorney, Agent, or Firm*—Charles J. Prescott

(57) ABSTRACT

An ignition spark enhancing system and devices which, in one aspect, establish the electrical path between a spark source (e.g. an ignition coil) and a spark plug, and in another aspect, between a power source (e.g. battery) and an ignition coil and, in a third aspect, between the ignition coil and the spark distributor of an internal combustion engine. The devices preferably include a coil of one or more turns or loops formed on and along a length of a small segment of hollow conductive tubing. A length of solid conductive wire is wound in tightly spaced fashion around a portion of the conductive tubing and is formed in intermittent segments which are preferably electrically coextensive with the conductive tubing. The tubing and the wire are preferably copper and also preferably form each entire spark plug and ignition coil wire. The device is also preferably coated with a non-conductive material to reduce any risk of electrical shock or short circuit.

13 Claims, 2 Drawing Sheets

IGNITION SPARK ENHANCING SYSTEM AND DEVICES THEREFOR

CROSS-REFERENCE TO RELATED APPLICATIONS

This is a continuation-in-part of application Ser. No. 10/832,021 filed Apr. 26, 2004, now U.S. Pat. No. 7,051,723.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to devices for increasing internal combustion engine efficiency, economy and performance, and more particularly to a coil wound conductive device formed of highly conductive tubing positioned in the pathway between the spark source and each spark plug of such engines.

2. Description of Related Art

In an internal combustion engine using a spark plug to ignite combustion, the intensity or voltage of the spark produced across the gap of the spark plug has a great deal to do with the efficiency, economy, power output and acceleration to full power of the internal combustion engine. A great deal of technology has therefore developed to enhance this functional aspect of the operation of the engine.

A number of prior art devices are known which have attempted to provide a "hotter" spark to the spark plugs to achieve the enhanced performance of the engine. One such prior patented device is disclosed in U.S. Pat. No. 4,944,280 invented by Washington which teaches a separated circuit or spark gap producing device that introduces an auxiliary gap into the electrical path between the spark source and the spark plug. This area of technology directed to producing a capacitive-type spark gap for enhanced voltage buildup before current is discharged and reaches the spark plug is well known. However, Washington developed an improved apparatus which accurately controls and varies this spark gap to achieve individual and selective adjustment of the size of the gap to achieve even more optimal performance from the engine.

Tagami in U.S. Pat. No. 5,109,828 teaches an apparatus for supplying high voltage to the spark plug via a spark coil and a distributor plate of unitary construction.

In U.S. Pat. No. 6,328,010, Thurman teaches a spark plug wire harness assembly having a substantially rigid body, plug wire mounting posts, and output terminals. The conductors are embedded within the rigid body.

An electrically controlled engine ignition system for increased power and economy was invented by Huan and disclosed in U.S. Pat. No. 4,784,100. This disclosure is of an ignition system which is capable of controllably adjusting the ignition spark and timing in accordance with conditions imposed on the automobile by road and driver habit.

My two prior U.S. Pat. Nos. 6,736,119 and 6,796,298 teach the use of a hollow coiled conductive tube positioned in each spark wire between the engine distributor and the spark plugs.

Another patent pending invention of mine disclosed in Ser. No. 10/832,031 filed Apr. 26, 2004 discloses a very simple, economical to manufacture and easy to install or incorporate into an originally manufactured spark plug wire extending from a spark source to the spark plug. The device, which in one embodiment is added to the spark plug wire itself in series therealong or, in another embodiment, at the end of the spark plug wire immediately adjacent to the spark plug, is formed of a length of highly conductive tubing, preferably copper tubing, having one or more loops of the coiled tubing formed therein. In still another embodiment, the entire spark plug wire is replaced with a single length of conductive tubing with a coiled segment formed therealong. This improvement has been shown to result in increased power, acceleration and economy. The preferred embodiment of the invention replaces the conventional spark plug wire in its entirety and replaces it preferably with a continuous length of copper tubing sized in inside and outside diameter to be substantially similar to that of the spark enhancing device itself. Alternately, the length of spark plug wire may be replaced by heavier current and voltage carrying spark plug wire formed of strands of solid copper wire encased within a shielding jacket or casing therefor.

The present invention is a further advancement of my prior patents and pending application by providing a thin, preferably solid copper wire wrapped preferably tightly and closely spaced over a segment of the conductive hollow tubing. The improved structure may also be used as a coil wire or a battery-to-coil connection.

BRIEF SUMMARY OF THE INVENTION

This invention is directed to an ignition spark enhancing device establishing the electrical path between a spark source (e.g. an ignition coil) and a spark plug and/or between a power source (e.g. battery) and a spark source and/or as an ignition coil of an internal combustion engine. The device includes a coil of one or more turns or loops formed of and along a length of hollow conductive tubing. A length of solid conductive wire is wound in tightly spaced fashion around a portion of the conductive tubing and is formed in intermittent segments which are preferably electrically coextensive with the conductive tubing. The tubing and the wire are preferably copper and also preferably forms each entire spark plug and ignition coil wire. The device is also preferably coated with a non-conductive material to reduce any risk of electrical shock or short circuit.

It is therefore an object of this invention to provide an improved spark enhancing device for the ignition system of an internal combustion engine.

Still another object of this invention is to provide a simple addition to each of the spark plug wires which has shown measurable improvement upon the performance of an internal combustion engine.

Yet another object of this invention is to provide an improved spark plug wire which conveys higher ignition voltage from an ignition source to the spark plug of an internal combustion engine.

Still another object of this invention is to provide an improved ignition system spark voltage at the spark plug without substantial radio interference produced therefrom.

And yet another object of this invention is to provide an improved ignition coil-to-distributor wire which enhances engine performance.

A still further object of this invention is to provide an improved electrical connection between the storage battery and the ignition coil for still further enhanced engine performance.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

My earlier teachings in U.S. Pat. Nos. 6,736,119 and 6,796,298 and pending application Ser. No. 10/832,021 filed Apr. 26, 2004 are incorporated herein by reference.

Figure 1:
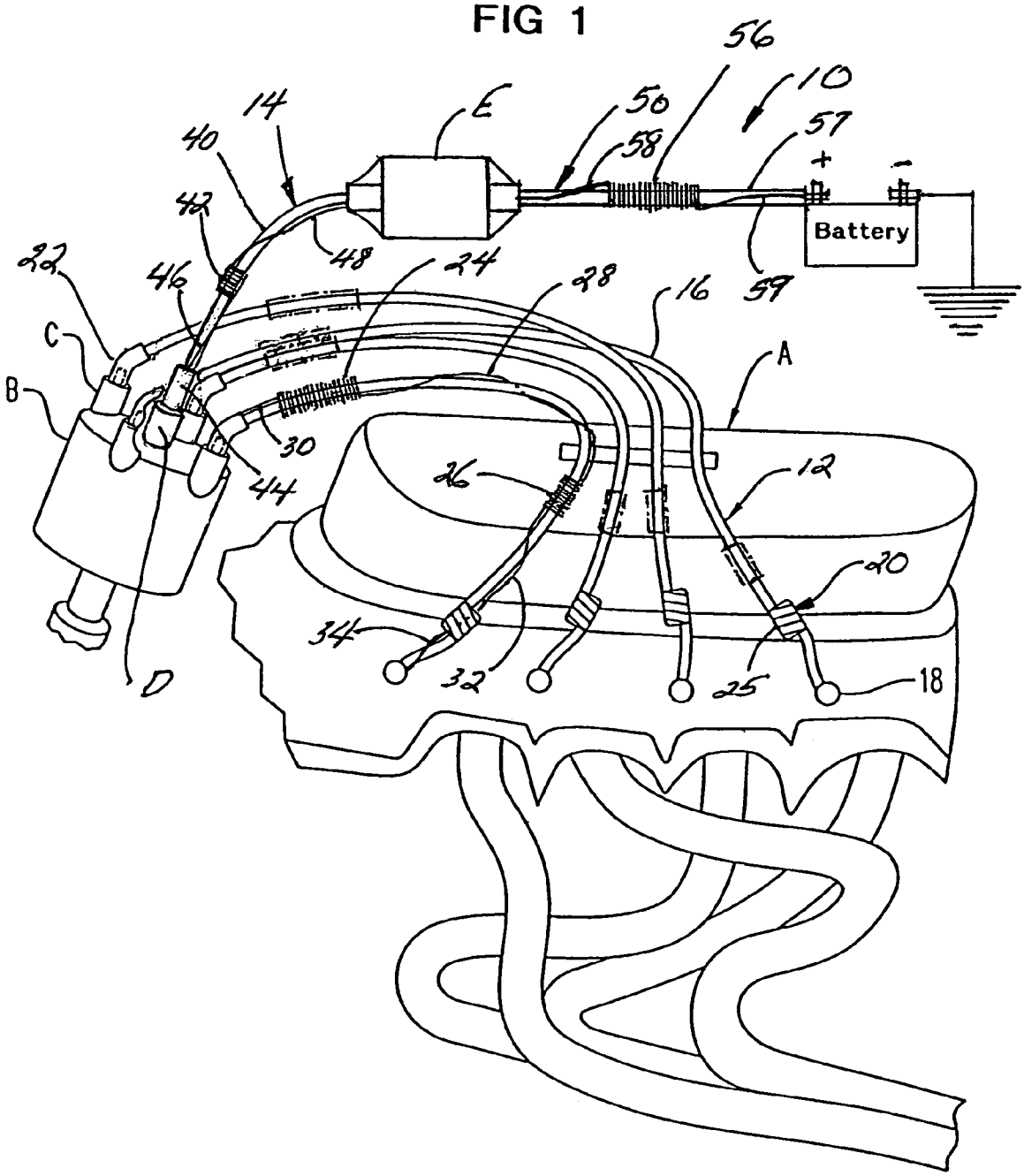
FIG. 1 is a perspective schematic view of the system of the invention one aspect formed into each spark plug wire, a second aspect serving as an ignition coil-to-distributor connection, and a third aspect forming the electrical connection between the vehicle battery and the ignition coil of an internal combustion engine.
Figures 2, 3, 4:
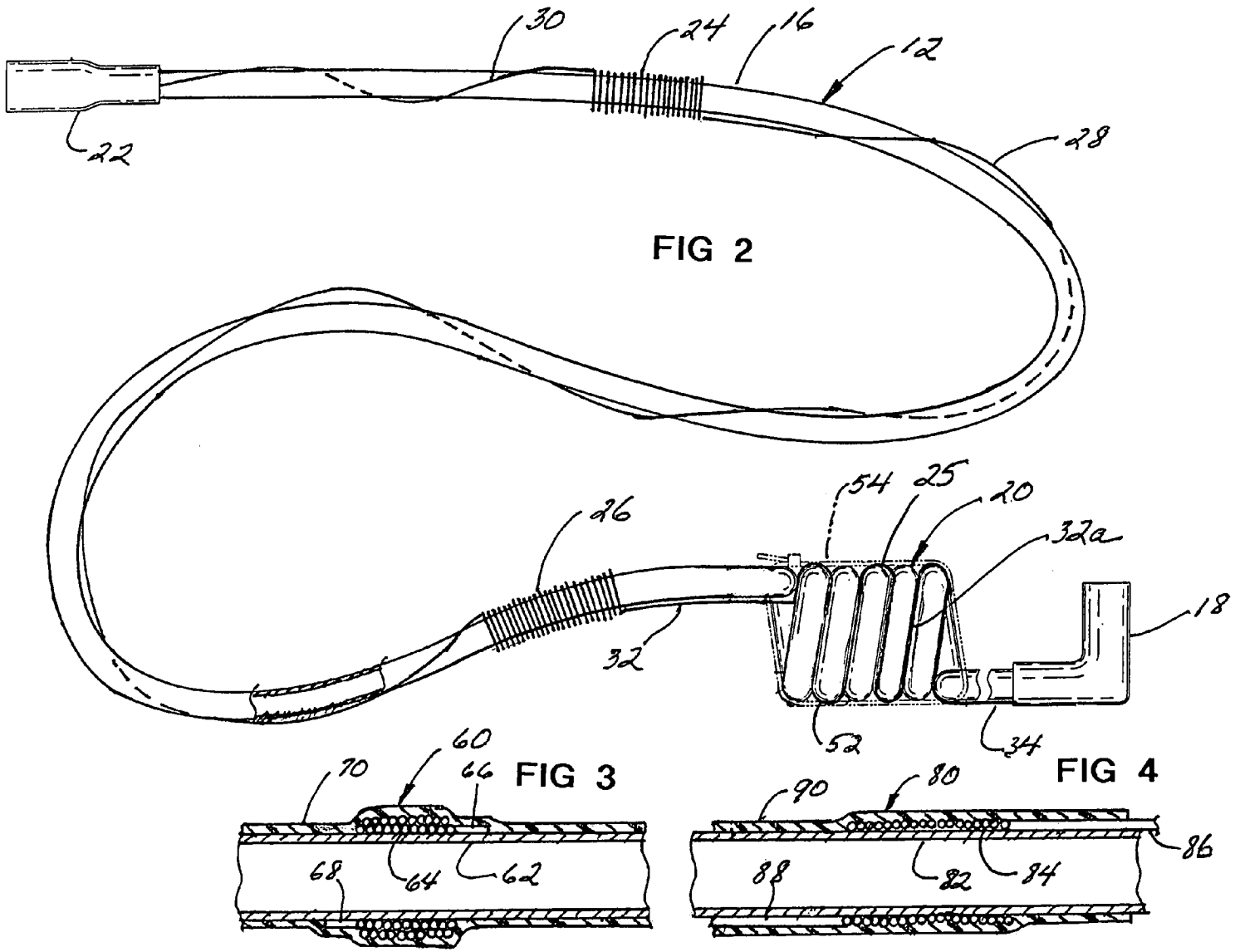
FIG. 2 is a perspective schematic view of the preferred embodiment of one aspect of the invention which totally replaces each spark plug wire of an internal combustion engine.
FIG. 3 is a side elevation section view of a short segment another embodiment of the spark enhancing device of the invention.
FIG. 4 is a side elevation section view of a short segment of still another embodiment of the spark enhancing device.

Referring now to the drawings, and particularly to FIGS. 1 and 2, the system of the invention, including several aspects thereof, is there shown generally at numeral 10 and includes an ignition and power enhancing system formed of a plurality of ignition wires shown generally at numeral 12, an ignition coil-to-distributor wire 14 and a battery or power source-to-coil wire 50.

Each ignition wire 12 is formed preferably of a single length of copper tubing 16 having an outside diameter (o.d.) of ⅛", an inside diameter (i.d.) of 1/16", and a wall thickness of 1/32" and preferably encapsulated in its entirety by an insulating layer 25 for electrical isolation thereof with respect to other grounded engine components or engine compartment structure. This preferred embodiment 12 is more economical to manufacture in that a single length of copper tubing with the insulating layer 25 formed thereon is then formed to include a sparkplug cap 18 at one end thereof and a distributor cap plug 22 formed at the other end thereof. The sparkplug cap 18 connects onto a conventional sparkplug (not shown) while the connector 22 is connected into an outlet port C of a distributor or spark source B.

Formed along the length of the isolated copper tubing 16 are a series of tightly wrapped coils or loops 52 which are wrapped around a mandrel having an o.d. of ½" to form an inner cylindrical surface defined by each of the loops 52. Note that a tie wrap 54 (shown in phantom) is preferably used to retain the tight uniform coiling in the position shown in FIG. 2.

Each of the sparkplug wires 12 further includes at least one segment 24 and/or 26 of tightly wrapped or wound solid copper wire having an o.d. of 0.023" (0.5 mm). Each of these tightly wound wire segments 24 and 26 wound directly against the outer surface of tube 16, have as preferred either eleven or thirty-three turns which have been found to be most advantageous to the invention. Further, each of these wound wire segments 24 and 26 may be in essence free-standing or extending along tube 16 as shown to terminate at the end of the windings or may preferably be in the form of a continuous wire having unwound segments 28, 30, 32 and 34, segment 28 interconnecting the two tightly wound portions 24 and 26, segment 32 spanning between wound segment 26 and coil 20, segment 30 extending between winding 24 and port C, and segment 34 extending from coil 20 and the sparkplug cap 18. Note that the preferred embodiment, the wire extends at 32*a* fitted tightly between each of the turns of the coil 20 before being held together by tie wrap 54 and encapsulated as previously described.

The ignition coil wire 14, which extends between the ignition coil E and the distributor B, includes coil-to-distributor member 40 formed as a length of conventional ignition wire or, preferably, a stiff, but bendable non-conductive plastic strap having a conductive connector 44 attached at one end which matably engages into the distributor inlet port D and a conductor (not shown) fitted into the outlet end of the coil E. A series of tightly wound turns of solid copper wire as previously described are wound around the central portion at 42 of the member 40. The copper wire extends at 48 between the winding 42 and the outlet of coil E and at 46 between the winding 42 and the conductor 44 fitted into the inlet D. Again, note that member 40 may be conductive or preferably non-conductive relying upon the conductivity and current transfer through the copper wire forming the winding 42 and the extensions 46 and 48 thereof.

Still referring to FIG. 1, a further preferred aspect of this invention is shown in the form of a power source or battery-to-coil connector 50. This connector 50 is preferably in the form of a non-conductive member 57, as above described, having a tightly wound winding 56 of conductive copper wire as previously described which extends at 59 to the positive (+) terminal of the battery and, at 58, to the inlet port of coil E. Again, although the member 57 is preferably non-conductive being formed of plastic strap or tubing, conventional ignition wire may be utilized as well.

Referring now to FIG. 3, one embodiment of the tightly wound wire winding is there shown in enlarged detail generally at numeral 60 and includes the hollow copper tubing conduit 62 as previously described, and a series of tightly wound wraps or turns of thin, solid copper wire at 64 each end of which terminates at 66 and 68 in electrical contact against the outer surface of the copper tubing 62. The entire arrangement is encapsulated with a non-conductive plastic or polymer covering 70 to resist electrical shorting with other grounded components of the engine or engine compartment area. Note that this winding embodiment 64 includes double-stacked tightly would rows one atop the other for compactness.

Referring now to FIG. 4, another embodiment of one aspect of the invention is there shown generally at numeral 80 and includes a length of the sparkplug ignition wire 82 formed of hollow conductive copper tubing as previously described. In this embodiment 80, the tightly wound solid copper wire turns 84 as previously described, are formed as a single row and extend over a greater length of the tubing member 82. Further in this embodiment 80, the solid conductive copper wire extends at 86 to one end of the hollow copper tubing 82 and at 88 to the other end of the copper tubing 82 so as to be electrically coextensive with each of the ignition wires 80 between the distributor and sparkplug. An encapsulating layer 90 formed of non-conductive plastic or polymeric or polyurethane material is provided over the entire structure to prevent electrical shortage.

Performance Results

Several simple empirical tests were conducted to verify the validity of the performance enhancing aspects of this invention. Applicant's background is in tree cutting and tree stump removal and he is extremely familiar with this type of equipment which supports these empirical observations. These tests are briefly described in the examples herebelow:

EXAMPLE A

A 2004 model Stihl chain saw having a 2hp gas engine installed with a series of solid copper wire turns as previously described along the ignition wire produced positive results in the range of 50% faster cutting power and having the horsepower feel of a larger 3hp chain saw.

EXAMPLE B

A copper wire winding was installed onto the ignition coil wire only of a straight hollow copper tube having an o.d. of ¼" and an i.d. of ⅛" on a 1999 Chevrolet Blazer having a V-6 engine. Prior to installation of the winding on the ignition coil, the economy of this vehicle ranged from 16 to 18 mpg in city driving. After installing the winding onto the ignition coil wire, the mileage increased to approximately 19 to 21.5 mpg.

EXAMPLE C

Using a 1987 Chevrolet ¾ ton chipper truck used in Applicant's tree service which typically achieved mileage of 10–12 mpg utilizing the sparkplug wires 12 previously described absent the copper windings 24/26. After installing a copper winding along the ignition wire 16, the mileage increased to between 13 and 14 mpg.

EXAMPLE D

A 1999 Dodge pick-up having a V-6 engine and having sparkplug ignition wires 12 as previously described typically achieved a mileage of between 390 to 400 miles per tank in highway driving. After installing the copper windings 24/26 along each of the ignition wires 12, the total distance per tank increased to 440 to 450 miles.

EXAMPLE E

A 1996 Jeep Grand Cherokee having ignition wires 12 as previously described clearly achieved a greater feeling of power and easier drivability and less fuel consumption when the copper wire winding 24/26 was installed along each of the ignition wires 12.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. An ignition sparkplug wire device connected or connectable in the electrical path between a spark source and a spark plug of an internal combustion engine comprising:

an elongated conductive hollow tubing formed to include a plurality of substantially concentric loops arranged in closely spaced helix fashion and extending along a first portion of said hollow tubing;

one end of said tubing connected to, or configured for connection to the spark source while the other end of said tubing is connected to, or configured for connection to, a spark plug;

a length of solid conductive pliable wire having a diameter substantially smaller than that of said tubing and wound around a second portion of said tubing in the form of closely or tightly spaced turns or wraps.

2. An ignition sparkplug wire as set forth in claim 1, wherein:

a ratio of said tubing diameter to said wire diameter is in the range of 10:1.

3. An ignition sparkplug wire as set forth in claim 1, wherein: said device is substantially coated with a non-conductive material.

4. An ignition sparkplug wire as set forth in claim 2, wherein:

said conductive wire extends in either direction from said first portion to each said end of said tubing.

5. An ignition sparkplug wire disposed in the electrical path between a spark source and a spark plug of an internal combustion engine comprising:

a coil having at least one complete loop formed into a length of electrically shielded conductive tubing connectable to the spark source at one end thereof and to a sparkplug to another end of said tubing;

a length of conductive wire having a diameter substantially smaller than that of said tubing and wound around a portion of said tubing with a plurality of closely spaced turns or wraps.

6. An ignition sparkplug wire as set forth in claim 5, wherein:

said device is substantially coated with a non-conductive material.

7. An ignition sparkplug wire as set forth in claim 5, wherein:

a ratio of said tubing diameter to said wire diameter is in the range of 10:1.

8. An ignition sparkplug wire as set forth in claim 5, wherein:

said wire extends in either direction from the wound portion thereof along a remainder of said tubing to each end thereof.

9. An ignition coil spark wire device connected or connectable in the electrical path between an ignition coil and a spark distributor for an internal combustion engine consisting of:

an elongated ignition coil-to-spark distributor member supporting a length of solid conductive wire tightly wound around only a small portion of a length of said ignition coil-to-spark distributor member forming a plurality of closely spaced turns or wraps;

a first end of said ignition coil-to-spark distributor member being connected to, or configured for connection to, the ignition coil while a second end of said ignition coil-to-spark distributor member being connected to, or configured for connection to, the spark distributor;

said conductive wire extending in either direction from the wound portion thereof along a remainder of said tubing to each end thereof.

10. An ignition coil spark wire as set forth in claim 9, wherein said ignition coil-to-spark distributor member includes:

a length of conductive hollow tubing including a coil having a plurality of substantially concentric loops arranged in closely spaced helix fashion.

11. A battery/power transfer wire connected or connectable in the electric path between a battery and an ignition coil for an internal combustion engine comprising:

an elongated battery ignition coil member supporting a length of solid conductive wire wound around a portion of said ignition coil-to-spark distributor member by a plurality of closely spaced turns or wraps;

a first end of said battery ignition coil member being connected to, or configured for connection to the ignition coil while a second end of said battery ignition coil member being connected to, or configured for connection to, the spark distributor;

said conductive wire extending in either direction from the wound portion thereof along a remainder of said tubing to each end thereof.

12. A battery/power transfer wire as set forth in claim 11, wherein said battery-to-ignition coil member includes:

a length of conductive hollow tubing including a coil having a plurality of substantially concentric loops arranged in closely spaced helix fashion.

13. An ignition spark system for an internal combustion engine comprising:

an ignition sparkplug wire device connected or connectable in the electrical path between a spark source and a spark plug of an internal combustion engine, including:

an elongated conductive hollow tubing formed to include a plurality of substantially concentric loops arranged in closely spaced helix fashion and extending along a first portion of said hollow tubing;

one end of said tubing connected to, or configured for connection to the spark source while the other end of said tubing is connected to, or configured for connection to, a spark plug;

a length of solid conductive pliable wire having a diameter substantially smaller than that of said tubing and wound around a second portion of said tubing in the form of closely or tightly spaced turns or wraps;

an ignition coil spark wire device connected or connectable in the electrical path between an ignition coil and a spark distributor for an internal combustion engine including:

an elongated ignition coil-to-spark distributor member supporting a length of solid conductive wire wound around a portion of said ignition coil-to-spark distributor member by a plurality of closely spaced turns or wraps;

a first end of said ignition coil-to-spark distributor member being connected to, or configured for connection to the ignition coil while a second end of said ignition coil-to-spark distributor member being connected to, or configured for connection to, the spark distributor;

said conductive wire extends in either direction from the wound portion thereof along a remainder of said tubing to each end thereof;

a battery/power transfer wire connected or connectable in the electric path between a battery and an ignition coil for an internal combustion engine including:

an elongated battery-to-ignition coil member supporting a length of solid conductive wire wound around a portion of said ignition coil-to-spark distributor member by a plurality of closely spaced turns or wraps;

a first end of said battery-to-ignition coil member being connected to, or configured for connection to the ignition coil while a second end of said battery-to-ignition coil member being connected to, or configured for connection to, the spark distributor;

said conductive wire extends in either direction from the wound portion thereof along a remainder of said tubing to each end thereof.

* * * * *